US012215516B2

(12) United States Patent
Wang

(10) Patent No.: US 12,215,516 B2
(45) Date of Patent: Feb. 4, 2025

(54) CURTAIN ASSEMBLY AND ASSEMBLING METHOD THEREOF

(71) Applicant: ALION HOME INC., La Puente, CA (US)

(72) Inventor: Guangtian Wang, Hacienda Heights, CA (US)

( * ) Notice: Subject to any disclaimer, the term of this patent is extended or adjusted under 35 U.S.C. 154(b) by 478 days.

(21) Appl. No.: 17/696,848

(22) Filed: Mar. 16, 2022

(65) Prior Publication Data

US 2023/0295952 A1 Sep. 21, 2023

(51) Int. Cl.
*A47H 5/00* (2006.01)
*E04H 15/58* (2006.01)

(52) U.S. Cl.
CPC ..... *E04H 15/58* (2013.01); *A47H 5/00* (2013.01)

(58) Field of Classification Search
CPC .. E04H 15/58; A47H 1/02; A47H 1/18; A47H 1/19; A47H 1/00; A47H 5/00; A47H 5/032; A47H 11/00; A47H 11/02; A47H 23/00; E06B 2009/2622; E06B 2009/2625; E06B 9/24
See application file for complete search history.

(56) References Cited

U.S. PATENT DOCUMENTS 3,777,800 A * 12/1973 Susoev ..... A47H 23/01 160/368.1
4,877,075 A * 10/1989 Markowitz ..... E06B 9/262 160/84.01
4,976,301 A * 12/1990 Easley ..... E06B 9/262 206/326
2006/0213625 A1* 9/2006 Nien ..... A47H 2/00 160/84.01
2007/0017643 A1* 1/2007 Lin ..... E06B 9/262 160/84.01
2011/0247761 A1* 10/2011 Lin ..... E06B 9/262 160/84.02

* cited by examiner

*Primary Examiner* — Daniel P Cahn
*Assistant Examiner* — Jeremy C Ramsey
(74) *Attorney, Agent, or Firm* — Tsz Lung Yeung

(57) ABSTRACT

A curtain assembly includes a curtain fabric, a upper supporting shaft, a lower supporting shaft, and a connecting cord. The connecting cord sequentially extends from a third supporting end portion along a corresponding side edge portion of the curtain fabric and repetitively pass through a first coupling hole of the upper supporting shaft to form a handle loop. The connecting cord passing through the first coupling hole further extends along a top edge portion of the curtain fabric and pass through a second coupling hole of the upper supporting shaft. The connecting cord passing through the second coupling hole further extends along a corresponding side edge portion of the curtain fabric to affixed on the lower supporting shaft. The curtain assembly is selectively operated between a shading position and a retracted position.

17 Claims, 11 Drawing Sheets

CURTAIN ASSEMBLY AND ASSEMBLING METHOD THEREOF

BACKGROUND OF THE PRESENT INVENTION

Field of Invention

The present invention relates to a curtain assembly, and more particularly to a curtain assembly which is simple to set up and does not utilize pulleys for actuating retraction of a curtain fabric.

Description of Related Arts

A conventional curtain assembly typically comprises a top supporting bar, a curtain member connected to the top supporting bar, and a curtain retraction system installed in the top supporting bar for releasing and retracting the curtain member. Conventionally, the curtain retraction system comprises a plurality of connecting strings engaging with a plurality of pulleys mounted on the top supporting bar. The connecting strings are connected to the curtain member so that when the connecting strings are pulled, the curtain member is retracted toward the top supporting bar. The curtain member may be configured as a curtain fabric or configured as comprising a plurality of shade panels.

There are several disadvantages in associated with the above-mentioned conventional curtain assembly. First, almost all conventional curtain assemblies utilize some sort of pulleys for retracting the curtain member. This makes the entire curtain assembly difficult to assemble and maintain. Overtime, the pulleys may not function as designed but it may be difficult for a user to replace just the pulleys. As a result, the entire curtain assembly may need to be replaced. Second, it is difficult to assemble the above-mentioned curtain assembly particularly in outdoor environment. When a user would like to set up a simple curtain assembly in outdoor environment for temporary use (such as a picnic), the above-mentioned curtain assembly is simply not suitable. The user may need to set up a tent or outdoor canopy for providing shade. However, such tent or canopy do not provide freely retractable curtain member as a feature.

As a result, there is a need to provide a curtain assembly which is simple to set up and does not utilize pulleys for actuating retraction of a curtain fabric.

SUMMARY OF THE PRESENT INVENTION

Certain variations of the present invention provide a curtain assembly which is simple to set up and does not utilize pulleys for actuating retraction of a curtain fabric.

In one aspect of the present invention, it provides a curtain assembly, comprising:

- a curtain fabric having a top edge portion, a bottom edge portion, and two side edge portions extending between the top edge portion and the bottom edge portion;
- a upper supporting shaft coupled to the top edge portion, the upper supporting shaft having a first supporting end portion, a second supporting end portion, a first coupling hole and a second coupling hole formed on the first supporting end portion and the second supporting end portion respectively;
- a lower supporting shaft coupled to the bottom edge portion of the curtain fabric, the lower supporting shaft having a third supporting end portion and a fourth supporting end portion; and

- a connecting cord having a first connecting end portion affixed to the third supporting end portion of the lower supporting shaft, and a second connecting end portion affixed to the fourth supporting end portion of the lower supporting shaft, the connecting cord sequentially extending from the third supporting end portion along the corresponding side edge portion of the curtain fabric and repetitively pass through the first coupling hole to form a handle loop, the connecting cord passing through the first coupling hole further extending along the top edge portion of the curtain fabric and pass through the second coupling hole, the connecting cord passing through the second coupling hole further extending along the corresponding side edge portion of the curtain fabric and being affixed on the lower supporting shaft, the curtain assembly being operated between a shading position and a retracted position, wherein in the shading position, the curtain fabric is fully extended between the upper supporting shaft and the lower supporting shaft, wherein in the retracted position, the handle loop is pulled and retained to pull the lower supporting shaft toward the upper supporting shaft so as to allow the curtain fabric to be retracted.

In another aspect of the present invention, it provides a method of manufacturing a curtain assembly, comprising the steps of:

- affixing an upper supporting shaft and a lower supporting shaft to a top edge portion and a bottom edge portion of a curtain fabric respectively;
- affixing a first connecting end portion of a connecting cord to a third supporting end portion of a lower supporting shaft;
- extending the connecting cord along a side edge portion of the curtain fabric 10 to repetitively pass through a first coupling hole of the upper supporting shaft to form a handle loop;
- extending the connecting cord along the top edge portion of the curtain fabric to pass through the second coupling hole of the upper supporting shaft; and
- downwardly extending the connecting cord along a corresponding side edge portion of the curtain fabric, and affixing a second connecting end portion of the connecting cord to a fourth supporting end portion of the lower supporting shaft to form the curtain assembly.

In another aspect of the present invention, it provides a method of manufacturing a curtain assembly, comprising the steps of:

- affixing an upper supporting shaft and a lower supporting shaft to a top edge portion and a bottom edge portion of a curtain fabric respectively;
- affixing a first connecting end portion of a connecting cord to a third supporting end portion of a lower supporting shaft;
- extending the connecting cord along a side edge portion of the curtain fabric to repetitively pass through a first coupling hole of the upper supporting shaft to form a handle loop, wherein the first coupling hole may be formed in a first extender ring of the upper supporting shaft;
- extending the connecting cord along the top edge portion of the curtain fabric to pass through the second coupling hole of the upper supporting shaft, wherein the second coupling hole may be formed in a second extender ring of the upper supporting shaft; and
- downwardly extending the connecting cord along a corresponding side edge portion of the curtain fabric, and affixing a second connecting end portion of the connecting cord to a fourth supporting end portion of the lower supporting shaft to form the curtain assembly.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" may refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection may refer to permanent connection or detachable connection. Therefore, the above terms should not be an actual connection limitation of the elements of the present invention.

Figure 1:
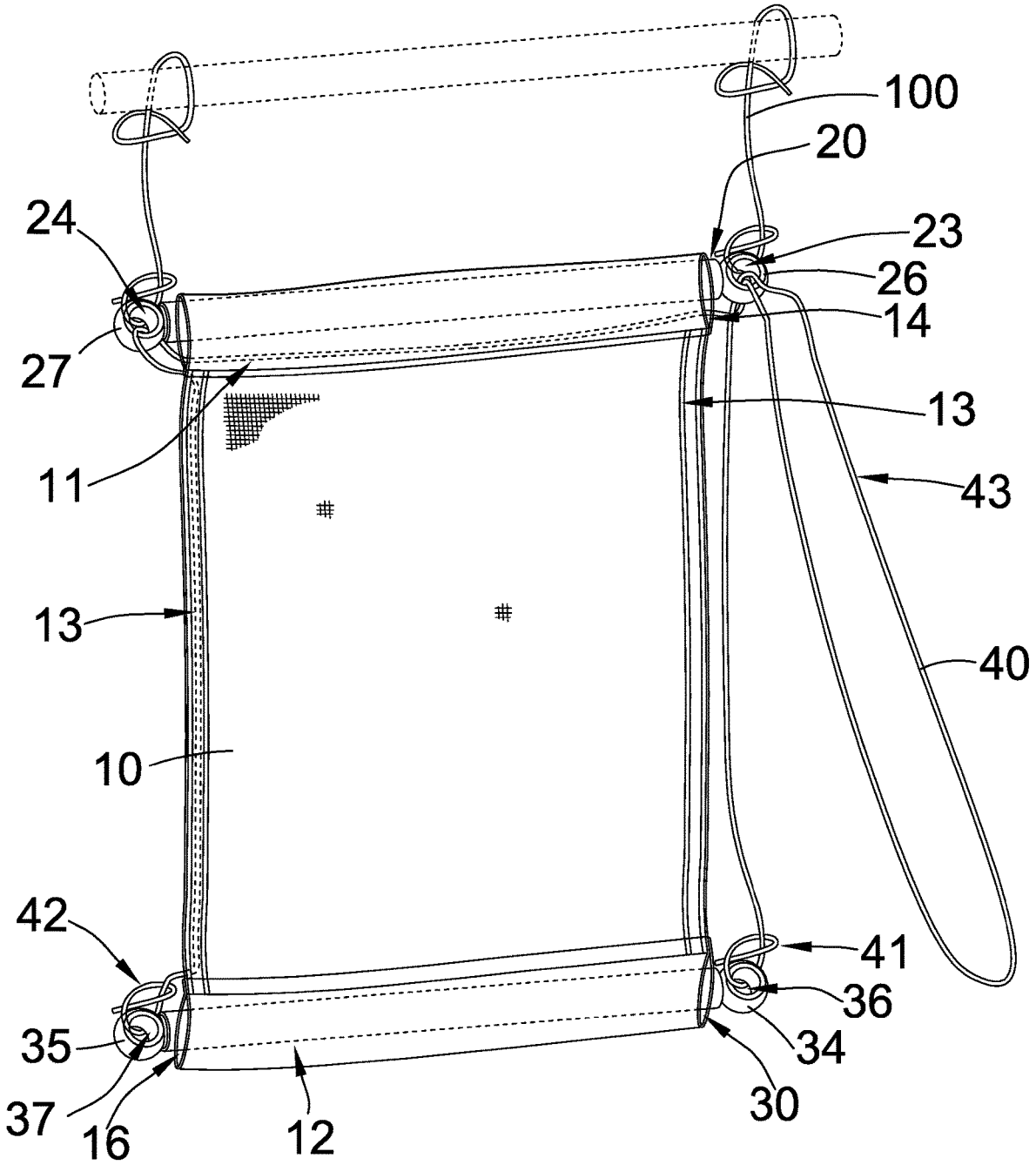
FIG. 1 is a perspective view of a curtain assembly according to a preferred embodiment of the present invention.
Figure 2:
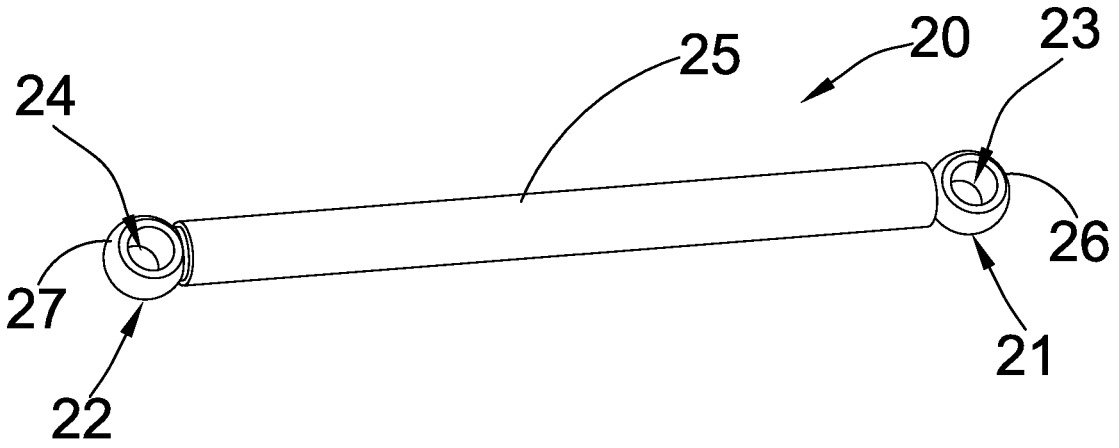
FIG. 2 is a perspective view of an upper supporting shaft of the curtain assembly according to the preferred embodiment of the present invention.
Figure 3:
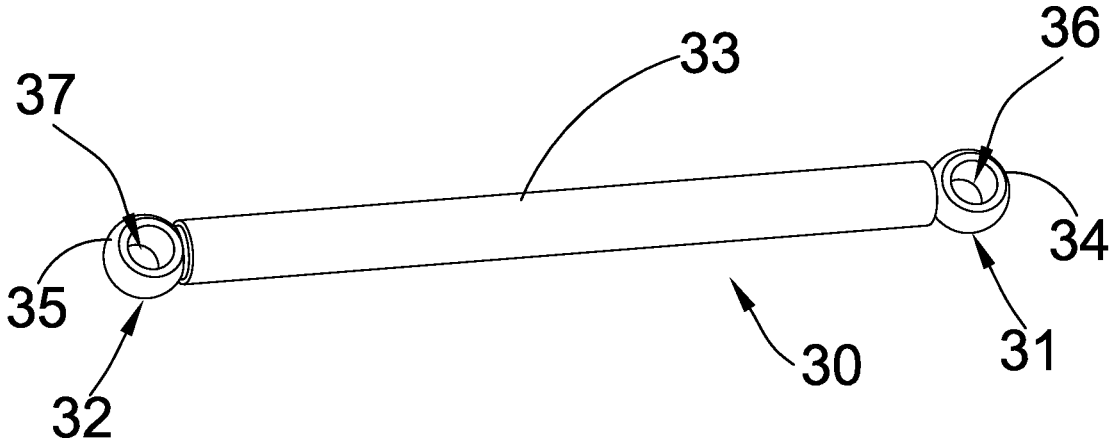
FIG. 3 is a perspective view of a lower supporting shaft of the curtain assembly according to the preferred embodiment of the present invention.

Referring to FIG. 1 to FIG. 3 of the drawings, a curtain assembly according to a preferred embodiment of the present invention is illustrated. Broadly, the curtain assembly may comprise a curtain fabric 10, an upper supporting shaft 20, a lower supporting shaft 30, and a connecting cord 40.

The curtain fabric 10 may have a top edge portion 11, a bottom edge portion 12, and two side edge portions 13 extending between the top edge portion 11 and the bottom edge portion 12.

The upper supporting shaft 20 may be detachably coupled to the top edge portion 11 of the curtain fabric 10. The upper supporting shaft 20 may have a first supporting end portion 21, a second supporting end portion 22, a first coupling hole 23 and a second coupling hole 24 formed on the first supporting end portion 21 and the second supporting end portion 22 respectively.

The lower supporting shaft 30 may be coupled to the bottom edge portion 12 of the curtain fabric 10. The lower supporting shaft 30 may have a third supporting end portion 31 and a fourth supporting end portion 32.

The connecting cord 40 may have a first connecting end portion 41 affixed to the third supporting end portion 31 of the lower supporting shaft 30, and a second connecting end portion 42 affixed to the fourth supporting end portion 32 of the lower supporting shaft 30. The connecting cord 40 may sequentially extend from the third supporting end portion 31 along the corresponding side edge portion 13 of the curtain fabric 10 and repetitively pass through the first coupling hole 23 to form a handle loop 43, the connecting cord 40 passing through the first coupling hole 23 may further extend along the top edge portion 11 of the curtain fabric 10 and pass through the second coupling hole 24, the connecting cord 40 passing through the second coupling hole 24 may further extend along the corresponding side edge portion 13 of the curtain fabric 10 and may be affixed on the fourth supporting end portion 32 of the lower supporting shaft 30.

The curtain assembly of the present invention may be operated between a shading position and a retracted position, wherein in the shading position, the curtain fabric 10 is fully extended between the upper supporting shaft 20 and the lower supporting shaft 30, wherein in the retracted position, the handle loop 43 may be pulled and retained to pull the lower supporting shaft 30 toward the upper supporting shaft 20 so as to allow the curtain fabric 10 to be retracted.

According to the preferred embodiment of the present invention, the curtain fabric 10 may be configured from textile or plastic material so that it may be utilized to block sunlight and provide shade. Additionally, the curtain fabric 10 may have a certain waterproof ability so that it may also be utilized to block a certain amount of water.

In this preferred embodiment of the present invention, the curtain fabric 10 may have a rectangular cross-sectional shape when viewed from the front and may have an upper elongated slot 14 extending along the top edge portion 11 so that the upper supporting shaft 20 and the corresponding portion of the connecting cord 40 may pass through the upper elongated slot 14.

The curtain fabric 10 may further have a lower elongated slot 16 extending along the bottom edge portion 12 so that the lower supporting shaft 30 may pass through the lower elongated slot 16. One skilled in the art may appreciate that the upper elongated slot 14 and the lower elongated slot 16 may be optionally provided on the curtain fabric 10. When the curtain fabric 10 does not have the upper elongated slot 14 and the lower elongated slot 16, the upper supporting shaft 20 and the lower supporting shaft 30 may simply extend along the upper edge portion 11 and the bottom edge portion 12 of the curtain fabric at a rear side or a front side thereof. In this preferred embodiment, the curtain fabric may have both the upper elongated slot 14 and the lower elongated slot 16 extending along the upper edge portion 11 and the bottom edge portion 12 respectively.

Referring to FIG. 1 of the drawings, the upper supporting shaft 20 may extend through the upper elongated slot 14 and may be suspendedly supported by at least one mounting cable 100. Thus, the mounting cable 100 may detachably fasten the upper supporting shaft 20 to an external object, such as an external bar, so as to secure the curtain assembly to that external object.

According to the preferred embodiment of the present invention, the upper supporting shaft 20 may comprise a first main shaft body 25, a first annular member 26 and a second annular member 27 detachably attached on two ends of the first main shaft body 25 respectively, wherein the first supporting end portion 21 and the second supporting end portion 22 are formed on the first annular member 26 and a second annular member 27 respectively. Thus, the first coupling hole 23 and the second coupling hole 24 may be formed on the first annular member 26 and a second annular member 27 respectively.

It is worth mentioning that the above-mentioned structure of the upper supporting shaft 20 may represent a particular configuration of the present invention. One skilled in the art may contemplate several alternatives of the upper supporting shaft 20. For example, the upper supporting shaft 20 may have a single first main shaft body 25 without the first annular member 26 and the second annular member 27, wherein the first supporting end portion 21 and the second supporting end portion 22 are formed as two ends portion thereof. As such, the first coupling hole 23 and the second coupling hole 24 may be directly formed on the first main shaft body 25 at two end portions thereof.

The first annular member 26 may be configured to have a ring-shape structure and may be detachably attached on one end of the first main shaft body 25. Similarly, the second annular member 27 may also be configured to have a ring-shape structure and may be detachably attached on another end of the first main shaft body 25. Thus, the first annular member 26 and the second annular member 27 may be opposite to each other. The connecting cord 40 may pass through the first annular member 26 and the second annular member 27 in the manner described above for lifting and releasing the curtain fabric 10. The first main shaft body 25, the first annular member 26 and the second annular member 27 may be configured from metallic material so as to offer strong structural integrity to support the curtain fabric 10.

As a slight alternative, the first main shaft body 25, the first annular member 26 and the second annular member 27 may form an integral structure so that the first annular member 26 and the second annular member 27 may not be detached from the first main shaft body 25.

The connecting cord 40 may have configured as a deformable, flexible and elongated cable or string and may be manufactured to withstand a predetermined amount of weight (at least the overall weight of the curtain assembly). The connecting cord 40 may be made from metallic or non-metallic material.

Referring to FIG. 1 and FIG. 3 of the drawings, the lower supporting shaft 30 may comprise a second main shaft body 33, a third annular member 34 and a fourth annular member 35 detachably attached on two ends of the second main shaft body 33 respectively, wherein the third supporting end portion 31 and the fourth supporting end portion 32 are formed on the third annular member 34 and a fourth annular member 35 respectively. The lower supporting shaft 30 may further have a third coupling hole 36 and the fourth coupling hole 37 formed on the third annular member 34 and the fourth annular member 35 respectively.

In this preferred embodiment, the first connecting end portion 41 and the second connecting end portion 42 may be detachably affixed to the third annular member 34 and the fourth annular member 35 respectively. One skilled in the art may also appreciate that the first connecting end portion 41 and the second connecting end portion 42 may also be affixed to any suitable positions on the lower supporting shaft 30.

It is worth mentioning that the above-mentioned structure of the lower supporting shaft 30 may also have several alternatives as in the case of the upper supporting shaft 20. For example, the lower supporting shaft 30 may have a single second main shaft body 33 without the third annular member 34 and the fourth annular member 35, wherein the third supporting end portion 31 and the fourth supporting end portion 32 are formed as two ends portion thereof. As such, the third coupling hole 36 and the fourth coupling hole 37 may be directly formed on the second main shaft body 33 at two end portions thereof.

Figure 5:
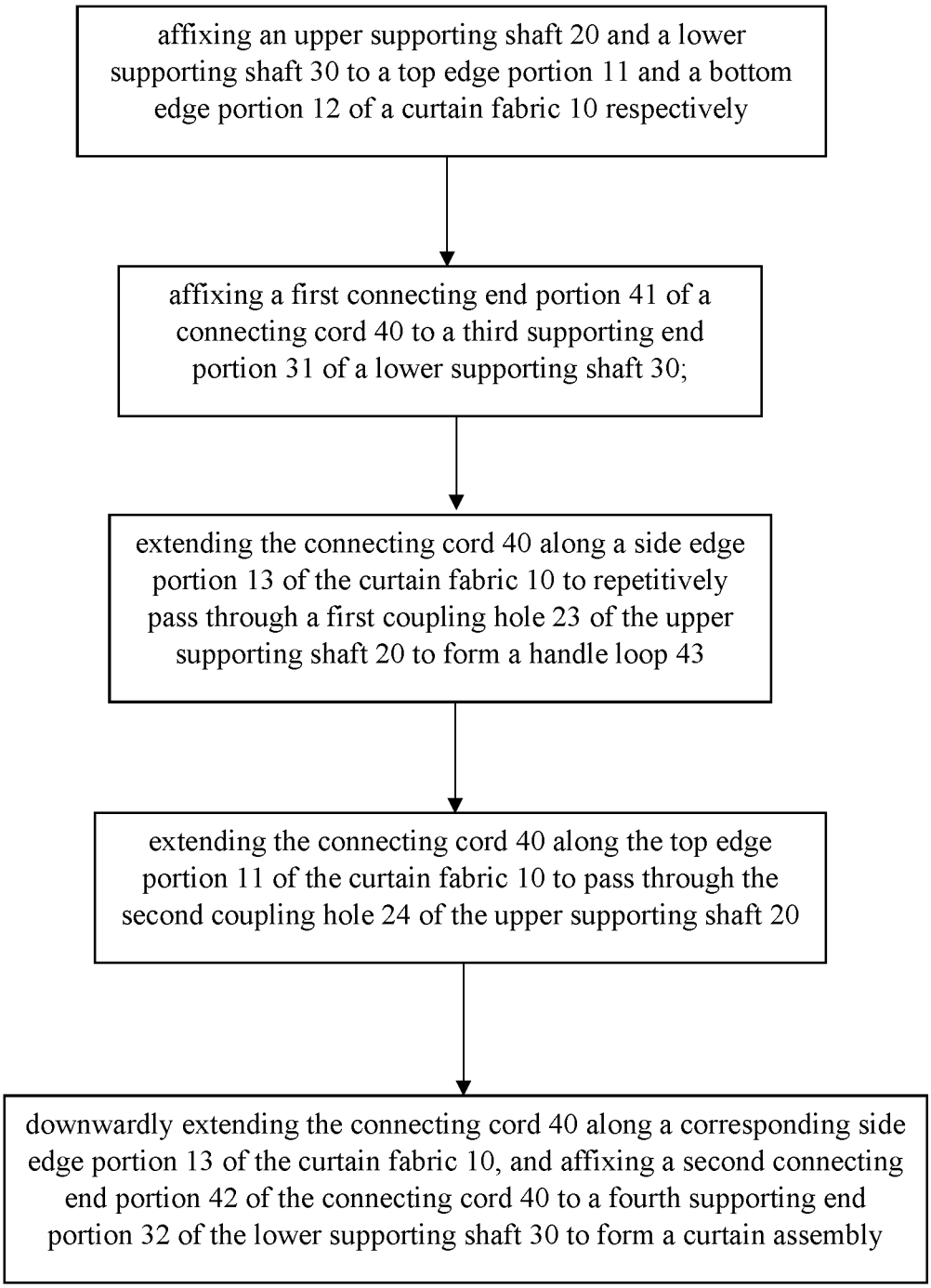
FIG. 5 is a block diagram illustrating a method of assembling a curtain assembly according to the preferred embodiment of the present invention.

Referring to FIG. 5 of the drawings, the present invention may also provide a method of manufacturing or assembling a curtain assembly, comprising the steps of:

(a) detachably affixing an upper supporting shaft 20 and a lower supporting shaft to a top edge portion 11 and a bottom edge portion 12 of a curtain fabric 10 respectively;

(b) detachably affixing a first connecting end portion 41 of a connecting cord 40 to a third supporting end portion 31 of a lower supporting shaft 30;

(c) extending the connecting cord 40 along a side edge portion 13 of the curtain fabric 10 to repetitively pass through a first coupling hole 23 of the upper supporting shaft to form a handle loop 43;

(d) extending the connecting cord 40 along the top edge portion 11 of the curtain fabric 10 to pass through the second coupling hole 24 of the upper supporting shaft 20; and (e) downwardly extending the connecting cord 40 along a corresponding side edge portion 13 of the curtain fabric 10, and affixing a second connecting end portion 42 of the connecting cord 40 to a fourth supporting end portion 32 of the lower supporting shaft 30 to form the curtain assembly.

In step (a), the upper supporting shaft 20 and the lower supporting shaft 30 may be inserted and extend along the upper elongated slot 14 and the lower elongated slot 16 of the curtain fabric 10 respectively so as to detachably affix the upper supporting shaft 20 and the lower supporting shaft 30 to the top edge portion 11 and the bottom edge portion 12 of the curtain fabric 10 respectively.

In step (c), the connecting cord 40 may pass through the first coupling hole 23 twice and form a handle loop underneath the first coupling hole 23. The handle loop 43 may be utilized for allowing a user to operate the curtain assembly (described below), and to secure the curtain assembly to an external object. The connecting cord 40 may upwardly extend from the first connecting end portion 41 along the corresponding side edge portion 13 of the curtain fabric and pass through the first coupling hole 23. The connecting cord may then downwardly extend from the first coupling hole 23 to a certain extent and go back up the first coupling hole 23 to form the handle loop 43 at a position underneath the upper supporting shaft 20.

Specifically in this preferred embodiment, the first connecting end portion 41 may be arranged to pass through the third coupling hole 36 and affix to the third annular member 34, as shown in FIG. 1 of the drawings.

In step (d), the connecting cord 40 may pass through the upper elongated slot 14 and extend from one side of the curtain fabric 10 to the other side. In step (e), the connecting cord 40 passing through the upper elongated slot 14 may further extend downwardly along the side edge portion 13 of the curtain fabric 10 and may be affixed to the fourth supporting end portion 32 of the lower supporting shaft 30. In this preferred embodiment, the second connecting end portion 42 may be arranged to pass through the fourth coupling hole 37 and affixed to the fourth annular member 32.

The operation of the present invention is as follows: the curtain assembly of the present invention may be operated between a shading position and a retracted position, wherein in the shading position, the curtain fabric 10 is fully extended between the upper supporting shaft 20 and the lower supporting shaft 30. The curtain fabric 10, due to its own weight, may fully extend and provide shading to an indoor or outdoor space.

On the other hand, when the curtain assembly is in the retracted position, the handle loop 43 may be detached from the external object and pulled by the user so that the lower supporting shaft 30 may be pulled upwardly toward the upper supporting shaft 20. As result, the curtain fabric 10 may be rolled or folded by the lower supporting shaft 30 so as to expose certain originally shaded area to sunlight. A user may then affix the handle loop 43 to an external object so as to retain the certain assembly in the retracted position.

Figure 4:
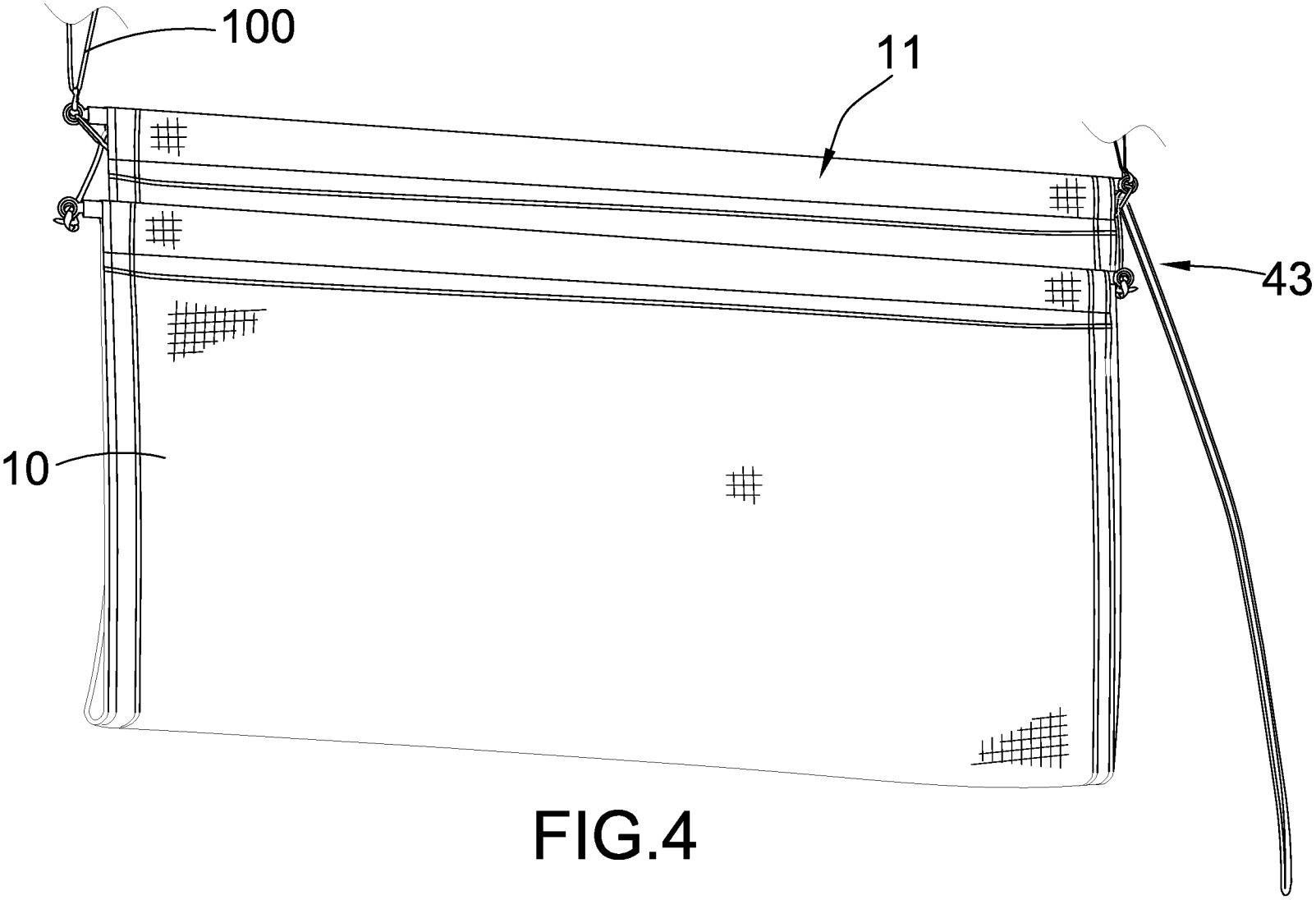
FIG. 4 is perspective view of a curtain assembly according to the preferred embodiment of the present invention, illustrating that the curtain assembly is in the retracted position.

One skilled in the art may appreciate that by adjusting the extent to which the handle loop 43 is pulled, the user of the present invention may manually adjust the extent to which the curtain fabric 10 is retracted. In other words, a user may selectively adjust the retraction of the curtain fabric 10 he or she may need due to a given circumstance, as shown in FIG. 4 of the drawings.

From the forgoing descriptions, it can be shown that the curtain assembly of the present invention is very easy to assemble without involving the use of any pulley. A user may easily set up the curtain assembly of the present invention in indoor or outdoor environment. After use, the user may also easily detach the curtain assembly (by unfastening the mounting cable 100) from the external object. All the components of the curtain assembly may be conveniently and compactly transported by a regular vehicle.

Figure 6:
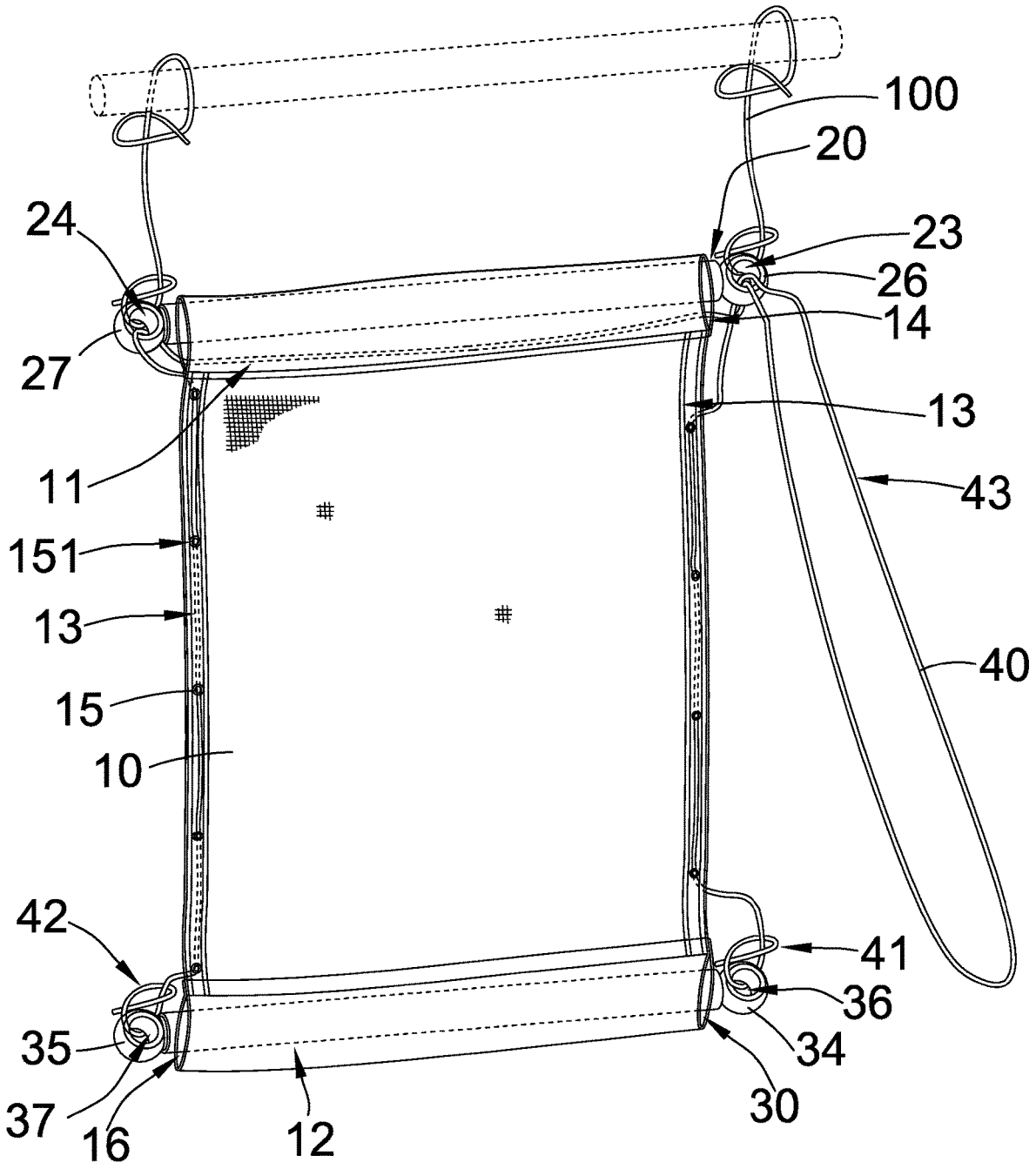
FIG. 6 is a first alternative mode of the curtain assembly according to the preferred embodiment of the present invention.

Referring to FIG. 6 of the drawings, a first alternative mode of the curtain fabric according to the preferred embodiment of the present invention is illustrated. The curtain assembly in the first alternative mode is structurally identical to that disclosed in the preferred embodiment, except that the curtain fabric 10 may further have a plurality of connecting holes 15 formed on the side edge portions 13 of the curtain fabric 10. A corresponding portion of the connecting cord 40 may pass through one of more of the connecting holes 15 so as to connect with the curtain fabric 10. Moreover, each of the connecting holes 15 may be reinforced by a metallic ring 151.

Figure 7:
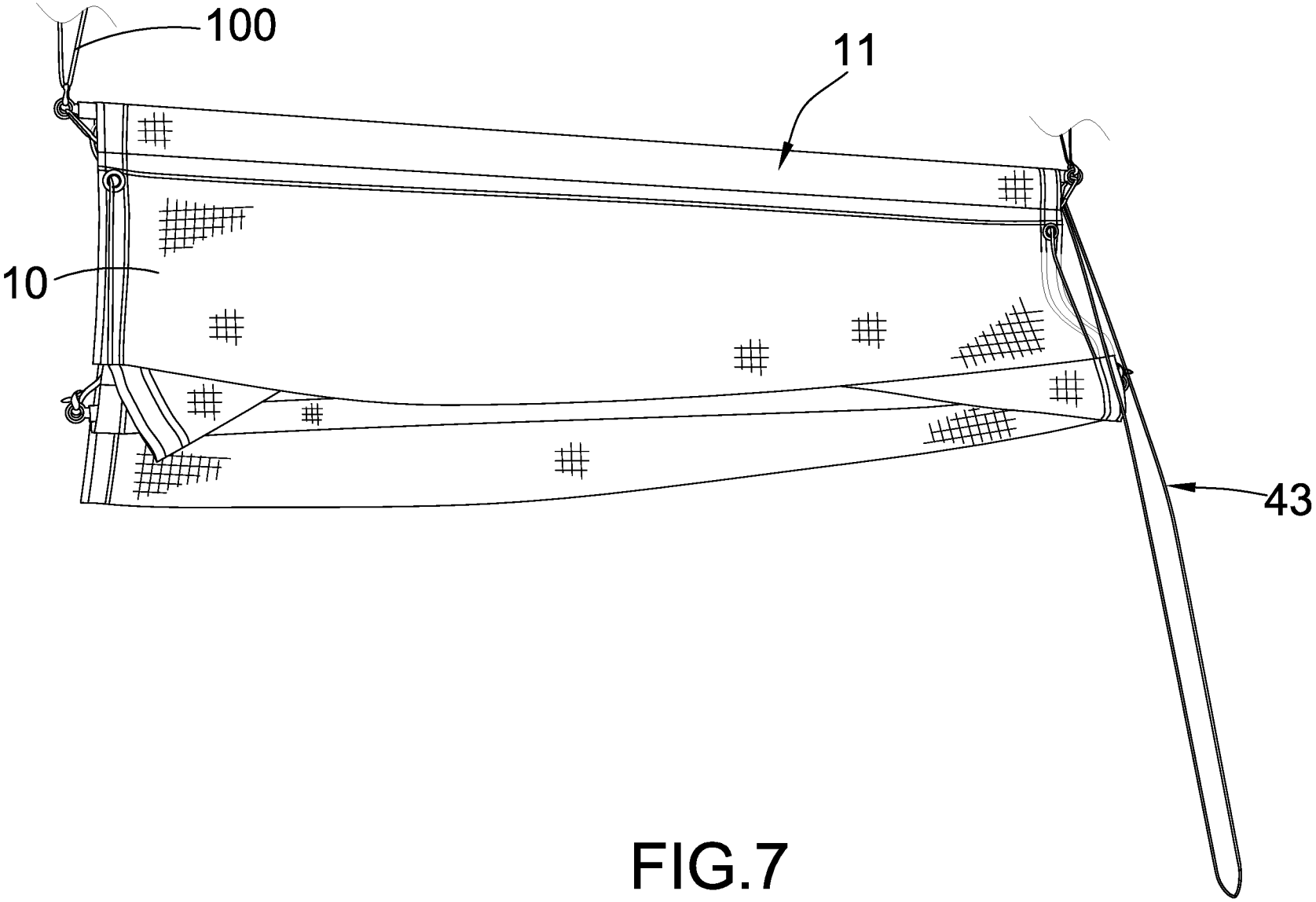
FIG. 7 is perspective view of a curtain assembly according to the first alternative mode of the present invention, illustrating that the curtain assembly is in the retracted position.

It is worth mentioning that since the connecting cord 40 may be arranged to pass through the connecting holes 15 while it extends along the corresponding side edge portion 13 of the curtain fabric 10, the curtain fabric 10 may be substantially retracted, as shown in FIG. 7 of the drawings.

Figure 8:
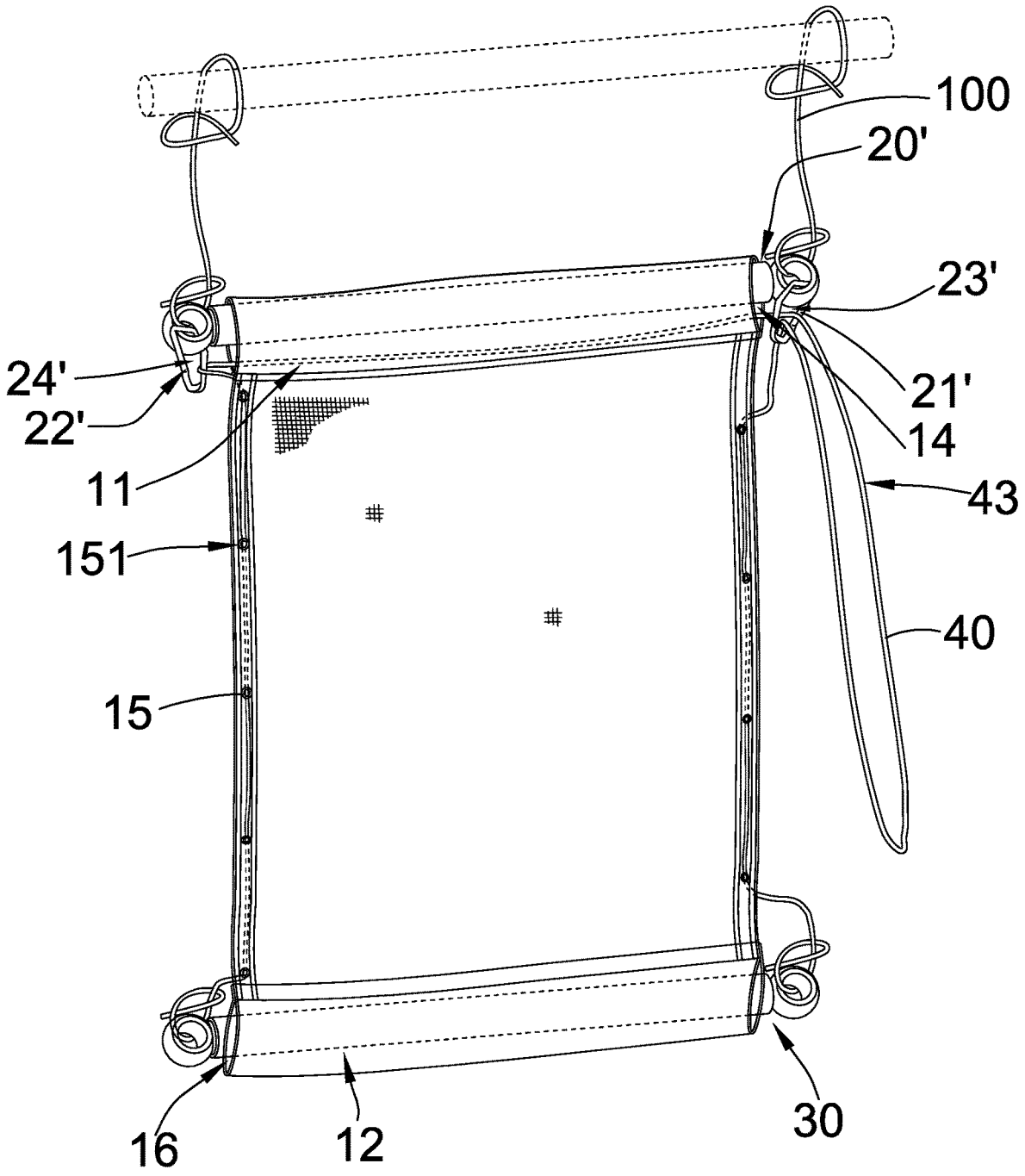
FIG. 8 is a second alternative mode of the curtain assembly according to the preferred embodiment of the present invention.
Figure 9:
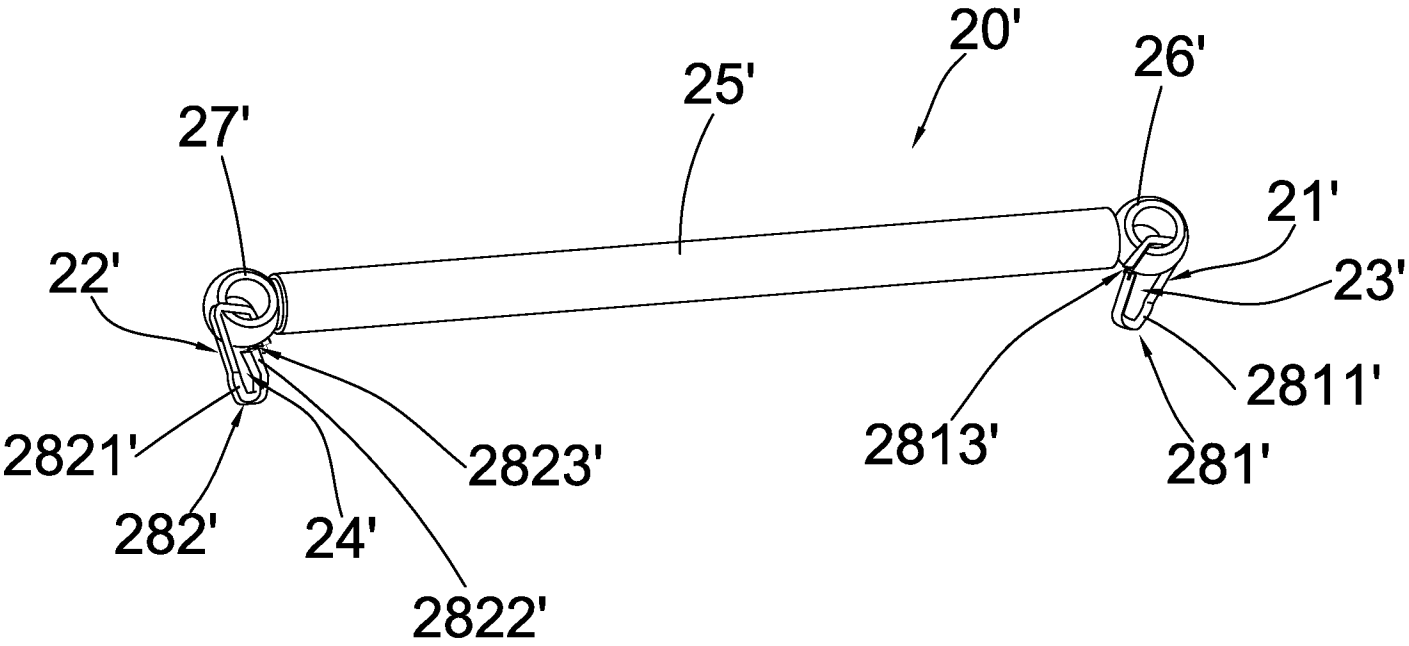
FIG. 9 is a perspective view of an upper supporting shaft of the curtain assembly according to the second alternative mode of the preferred embodiment of the present invention.
Figure 10:
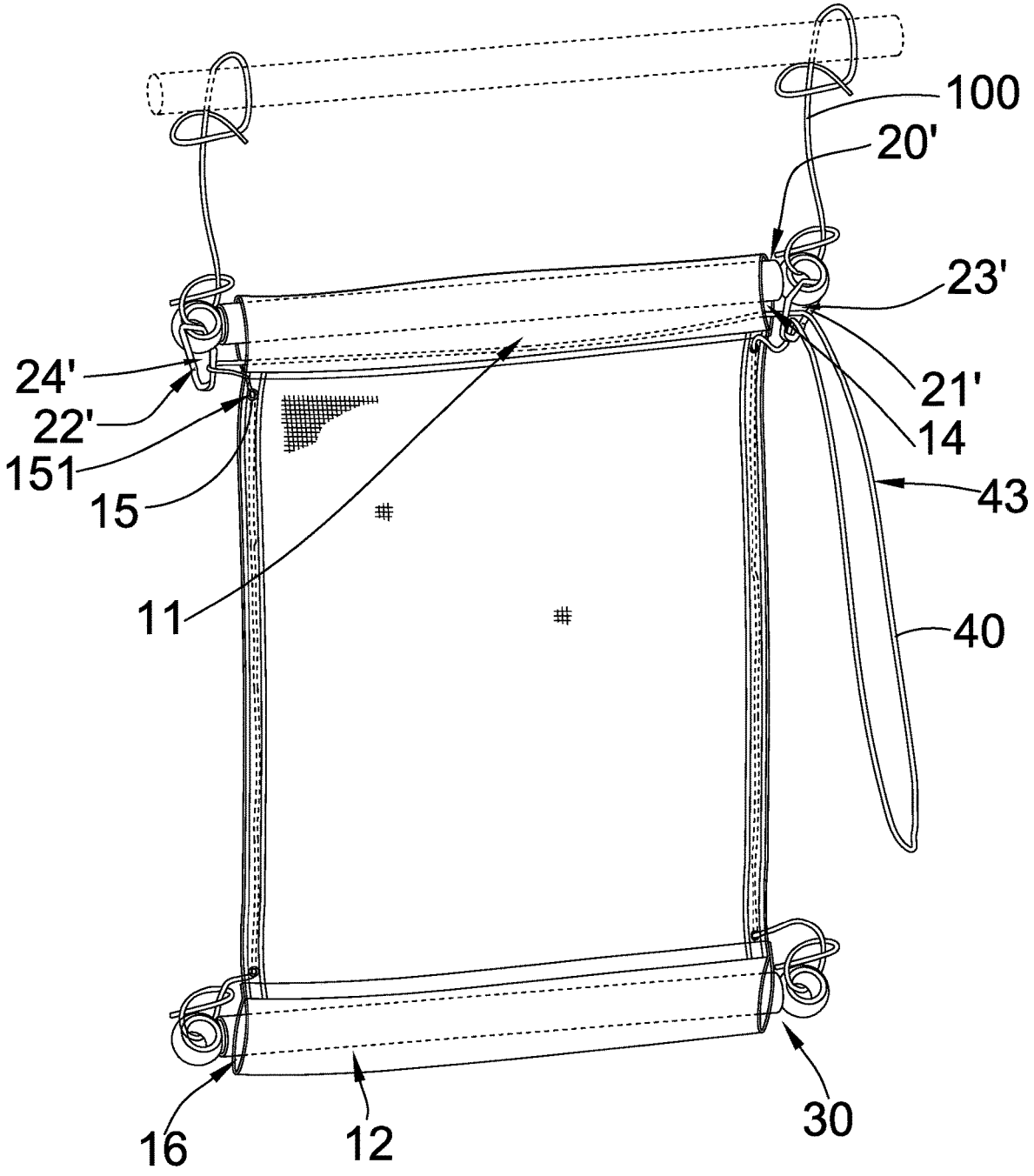
FIG. 10 another perspective view of the upper supporting shaft of the curtain assembly according to the second alternative mode of the preferred embodiment of the present invention, illustrating the number of holes may be varied.

Referring to FIG. 8 to FIG. 10 of the drawings, a second alternative mode of the curtain fabric according to the preferred embodiment of the present invention is illustrated. The second alternative mode is very similar to the preferred embodiment described above, except the upper supporting shaft 20'. In addition, the manner in which the connecting cord 40 is attached on the curtain fabric 10 is also different from the preferred embodiment described above. Other components are structurally identical to what have been disclosed in the preferred embodiment above.

Thus, according to the second alternative mode, the curtain assembly may comprise the curtain fabric 10, an upper supporting shaft 20', the bottom supporting shaft 30, and the connecting cord 40.

The upper supporting shaft 20' may be coupled to the top edge portion 11. The upper supporting shaft 20' may have a first supporting end portion 21', a second supporting end portion 22', a first coupling hole 23' and a second coupling hole 24' formed on the first supporting end portion 21' and the second supporting end portion 22' respectively.

Specifically, the upper supporting shaft 20' may comprise a first main shaft body 25', a first annular member 26', a second annular member 27' detachably attached on two ends of the first main shaft body 25' respectively, a first extender ring 281' and a second extender ring 282' detachably attached on the first annular member 26' and the second annular member 27' respectively. The first coupling hole 23' and the second coupling hole 24' may be formed in the first extender ring 281' and the second extender ring 282' respectively. The purpose of the first extender ring 281' and the second extender ring 282' is to enhance a smoothness of the movement of the connecting cord 40 so as to enhance the smoothness of the retracting motion of the curtain fabric 10.

Thus, the first extender ring 281' and the second extender ring 282' may constitute the first supporting end portion 21' and the second supporting end portion 22' of the upper supporting shaft 20', while the first coupling hole 23' and the second coupling hole 24' may be formed in the first extender ring 281' and the second extender ring 282' respectively.

The connecting cord 40 may have a first connecting end portion 41 affixed to the third supporting end portion 31 of the lower supporting shaft 30, and a second connecting end portion affixed to the fourth supporting end portion 32 of the lower supporting shaft 30. The connecting cord 40 may sequentially extend from the third supporting end portion 31 along the corresponding side edge portion 13 of the curtain fabric 10 and repetitively pass through the first coupling hole 23' to form a handle loop 43, the connecting cord passing through the first coupling hole 23' may further extend along the top edge portion 11 of the curtain fabric 10 and pass through the second coupling hole 24', the connecting cord 40 passing through the second coupling hole 24' may further extend along the corresponding side edge portion 13 of the curtain fabric 10 and may be affixed on the lower supporting shaft 30.

Again, the curtain assembly may be operated between a shading position and a retracted position, wherein in the shading position, the curtain fabric 10 may be fully extended between the upper supporting shaft 20 and the lower supporting shaft 30, wherein in the retracted position, the handle loop 43 may be pulled and retained to pull the lower supporting shaft 30 toward the upper supporting shaft 20 so as to allow the curtain fabric to be retracted.

According to the second alternative mode of the present invention, the curtain fabric 10 may have a rectangular cross sectional shape when viewed from the front and may have the upper elongated slot 14 extending along the top edge portion 11 so that the upper supporting shaft 20 and the corresponding portion of the connecting cord 40 may pass through the upper elongated slot 14. The curtain fabric 10 may further have the plurality of connecting holes 15 formed on the side edge portions 13 of the curtain fabric 10. A corresponding portion of the connecting cord 40 may pass through one of more of the connecting holes 15 so as to connect with the curtain fabric 10. Each of the connecting holes 15 may be reinforced by a metallic ring 151.

Moreover, the curtain fabric 10 may also have the lower elongated slot 16 extending along the bottom edge portion 12 so that the lower supporting shaft 30 may pass through the lower elongated slot 14. One skilled in the art may appreciate that the upper elongated slot 14 and the lower elongated slot 16 may be optionally provided in the curtain fabric 10.

The number of connecting holes 15 may be varied according to the circumstances in which the present invention is utilized. For example, as shown in FIG. 8 of the drawings, several connecting holes 15 may be formed on along each of the side edge portions 13 of the curtain fabric 10. Alternatively, as shown in FIG. 10 of the drawings, each of the side edge portions 13 may only have two connecting holes 15 formed near the top edge portion 11 and the bottom edge portion 12 respectively. The connecting cord 40 may pass through the connecting holes 15 near the top edge portion 11 and extend along the side edge portions 13 on a rear side of the curtain fabric 10.

The first extender ring 281' may detachably connect to the first annular member 26'. Specifically, the first extender ring 281' may comprise a first main frame 2811' and a first pin member 2812' pivotally connected to the main frame 2811'. The first main frame 2811' may be bent to form a first loop having a first opening 2813', wherein the first pin member 2812' may be pivotally connected to the first main frame 2811' to selectively close and open the first opening 2813'. A first resilient member may be connected to the first main frame 2811' to bias against the first pin member 2812' so as to normally close the first opening 2813' and the loop. Note that the first coupling hole 23' may be formed as the through opening within the first extender ring 281' (i.e. the space surrounded by the loop and the first pin member 2812').

Similarly, the second extender ring 282' may detachably connect to the second annular member 27'. Specifically, the second extender ring 282' may comprise a second main frame 2821' and a second pin member 2822' pivotally connected to the main frame 2821'. The second main frame 2821' may be bent to form a loop having a second opening 2823', wherein the second pin member 2822' may be pivotally connected to the second main frame 2821' to selectively close and open the second opening 2823'. A second resilient member may be connected to the second main frame 2821' to bias against the second pin member 2822' so as to normally close the second opening 2823' and the loop. Note that the second coupling hole 24' may be formed as the through opening within the second extender ring 282' (i.e. the space surrounded by the second loop and the second pin member 2822')

Figure 12:
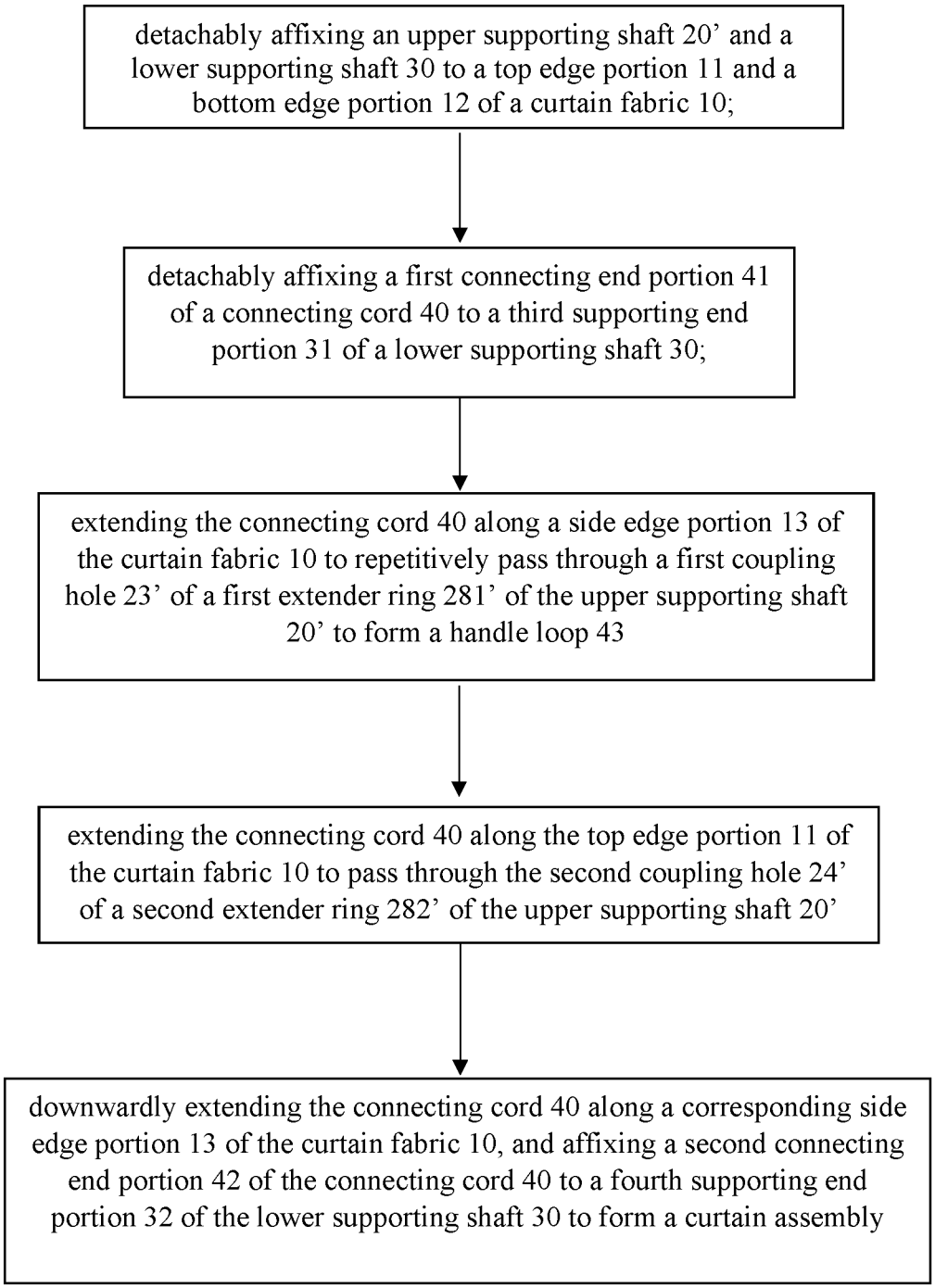
FIG. 12 is a block diagram illustrating a method of assembling a curtain assembly according to the second alternative mode of the preferred embodiment of the present invention.

As shown in FIG. 12 of the drawings, the present invention also provides a method of manufacturing or assembling a curtain assembly, comprising the steps of:

(1) detachably affixing an upper supporting shaft 20' and a lower supporting shaft to a top edge portion 11 and a bottom edge portion 12 of a curtain fabric 10 respectively;

(2) detachably affixing a first connecting end portion 41 of a connecting cord 40 to a third supporting end portion 31 of a lower supporting shaft 30;

(3) extending the connecting cord 40 along a side edge portion 13 of the curtain fabric 10 to repetitively pass through a first coupling hole 23' of the upper supporting shaft 20' to form a handle loop 43, wherein the first coupling hole 23' may be formed in a first extender ring 281' of the upper supporting shaft 20';

(4) extending the connecting cord 40 along the top edge portion 11 of the curtain fabric 10 to pass through the second coupling hole 24' of the upper supporting shaft 20', wherein the second coupling hole 24' may be formed in a second extender ring 282' of the upper supporting shaft 20'; and (5) downwardly extending the connecting cord 40 along a corresponding side edge portion 13 of the curtain fabric 10, and affixing a second connecting end portion 42 of the connecting cord 40 to a fourth supporting end portion 32 of the lower supporting shaft 30 to form the curtain assembly.

In step (3) and step (4) above, the connecting cord 40 may be arranged to pass through the connecting holes 15 while it extends along the corresponding side edge portion 13 of the curtain fabric 10. This arrangement allows the entire curtain fabric 10 to be retracted when the handle loop is pulled by the user of the present invention.

The operation of the present invention is as follows: the curtain assembly of the present invention may be operated between a shading position and a retracted position, wherein in the shading position, the curtain fabric 10 is fully extended between the upper supporting shaft 20' and the lower supporting shaft 30. The curtain fabric 10, due to its own weight, may fully extend and provide shading to an indoor or outdoor space.

On the other hand, when the curtain assembly is in the retracted position, the handle loop 43 may be detached from the external object and pulled by the user so that the lower supporting shaft 30 may be pulled upwardly toward the upper supporting shaft 20'. As result, the curtain fabric 10 may be rolled or folded by the lower supporting shaft 30 so as to expose certain originally shaded area to sunlight. A user may then affix the handle loop 43 to an external object so as to retain the certain assembly in the retracted position.

It is worth mentioning that since the connecting cord 40 may be arranged to pass through the connecting holes 15 while it extends along the corresponding side edge portion 13 of the curtain fabric 10, the curtain fabric 10 may be substantially retracted in such a manner that the curtain fabric may be repetitively folded to expose more sunlight to a designated area.

Figure 11:
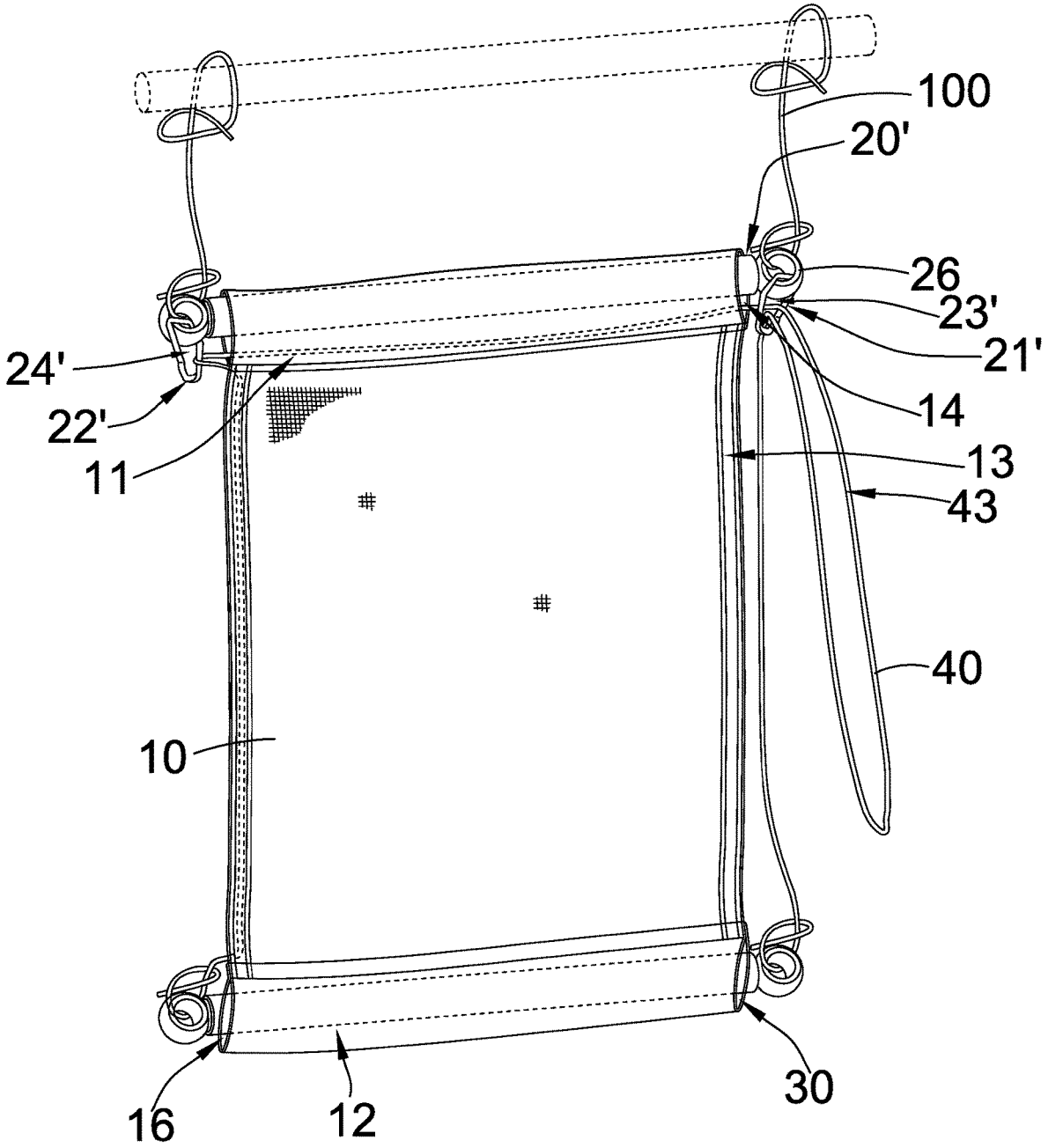
FIG. 11 is a perspective view of an upper supporting shaft of the curtain assembly according to the second alternative mode of the preferred embodiment of the present invention, illustrating that the curtain fabric does not contain connecting holes.

On skilled in the art may also appreciate that the curtain fabric 10 may not have the connecting holes 15, and in this situation, the connecting cord 40 may simply extend along the side edge portions 13 of the curtain fabric 10 at a rear or a front side thereof, as shown in FIG. 11 of the drawings.

The present invention, while illustrated and described in terms of a preferred embodiment and several alternatives, is not limited to the particular description contained in this specification. Additional alternative or equivalent components could also be used to practice the present invention.

What is claimed is:

1. A curtain assembly, comprising:

a curtain fabric having a top edge portion, a bottom edge portion, and two side edge portions extending between said top edge portion and said bottom edge portion;

an upper supporting shaft coupled to said top edge portion, said upper supporting shaft having a first supporting end portion, a second supporting end portion, a first coupling hole and a second coupling hole formed on said first supporting end portion and said second supporting end portion respectively;

a lower supporting shaft coupled to said bottom edge portion of said curtain fabric, said lower supporting shaft having a third supporting end portion and a fourth supporting end portion; and a connecting cord having a first connecting end portion affixed to said third supporting end portion of said lower supporting shaft, and a second connecting end portion affixed to said fourth supporting end portion of said lower supporting shaft, said connecting cord sequentially extending from said third supporting end portion along one of said side edge portions of said curtain fabric and repetitively passing through said first coupling hole to form a handle loop, said connecting cord repetitively passing through said first coupling hole then further extending along said top edge portion of said curtain fabric and passing through said second coupling hole, said connecting cord passing through said second coupling hole further extending along said corresponding side edge portion of said curtain fabric and being affixed on said lower supporting shaft, said curtain assembly being operated between a shading position and a retracted position, wherein in said shading position, said curtain fabric is fully extended between said upper supporting shaft and said lower supporting shaft, wherein in said retracted position, said handle loop is pulled and retained to pull said lower supporting shaft toward said upper supporting shaft so as to allow said curtain fabric to be retracted.

2. The curtain assembly, as recited in claim 1, wherein said curtain fabric further has an upper elongated slot extending along said top edge portion so that said upper supporting shaft and a corresponding portion of said connecting cord are adapted to pass through said upper elongated slot.

3. The curtain assembly, as recited in claim 2, wherein said curtain fabric further has a lower elongated slot extending along said bottom edge portion so that said lower supporting shaft is adapted to pass through said lower elongated slot.

4. The curtain assembly, as recited in claim 3, wherein said upper supporting shaft comprises a first main shaft body, a first annular member and a second annular member detachably attached on two ends of said first main shaft body respectively, wherein said first supporting end portion and said second supporting end portion are formed on said first annular member and a second annular member respectively, such that said first coupling hole and said second coupling hole are formed on said first annular member and a second annular member respectively.

5. The curtain assembly, as recited in claim 4, wherein said lower supporting shaft comprises a second main shaft body, a third annular member and a fourth annular member detachably attached on two ends of said second main shaft body respectively, wherein said third supporting end portion and said fourth supporting end portion are formed on said third annular member and a fourth annular member respectively, said lower supporting shaft further having a third coupling hole and a fourth coupling hole formed on said third annular member and said fourth annular member respectively, said first connecting end portion of said connecting cord and said second connecting end portion of said connecting cord are detachably affixed to said third annular member and said fourth annular member respectively.

6. The curtain assembly, as recited in claim 5, wherein said curtain fabric further has a plurality of connecting holes formed on said side edge portions of said curtain fabric, wherein said connecting cord is arranged to pass through one of said connecting holes when extending through said side edge portions of said curtain fabric.

7. The curtain assembly, as recited in claim 3, wherein said upper supporting shaft comprises a first main shaft body, a first annular member, a second annular member detachably attached on two ends of said first main shaft body respectively, a first extender ring and a second extender ring detachably attached on said first annular member and said second annular member respectively, said first extender ring and said second extender ring constituting said first supporting end portion and said second supporting end portion of said upper supporting shaft so that said first coupling hole and said second coupling hole are formed in said first extender ring and said second extender ring respectively.

8. The curtain assembly, as recited in claim 7, wherein said first extender ring comprises a first main frame and a first pin member pivotally connected to said main frame, said first main frame is bent to form a first loop having a first opening, wherein said first pin member is pivotally connected to said first main frame to selectively close and open said first opening.

9. The curtain assembly, as recited in claim 8, wherein said second extender ring comprises a second main frame and a second pin member pivotally connected to said main frame, said second main frame is bent to form a second loop having a second opening, wherein said second pin member is pivotally connected to said second main frame to selectively close and open said second opening.

10. The curtain assembly, as recited in claim 9, wherein said lower supporting shaft comprises a second main shaft body, a third annular member and a fourth annular member detachably attached on two ends of said second main shaft body respectively, wherein said third supporting end portion and said fourth supporting end portion are formed on said third annular member and a fourth annular member respectively, said lower supporting shaft further having a third coupling hole and a fourth coupling hole formed on said third annular member and said fourth annular member respectively, said first connecting end portion of said connecting cord and said second connecting end portion of said connecting cord are detachably affixed to said third annular member and said fourth annular member respectively.

11. The curtain assembly, as recited in claim 10, wherein said curtain fabric further has a plurality of connecting holes formed on said side edge portions of said curtain fabric, wherein said connecting cord is arranged to pass through one of more of said connecting holes when extending through said side edge portions of said curtain fabric.

12. A method of assembling a curtain assembly, comprising the steps of:

(a) detachably affixing an upper supporting shaft and a lower supporting shaft to a top edge portion and a bottom edge portion of a curtain fabric respectively;

(b) detachably affixing a first connecting end portion of a connecting cord to a supporting end portion of said lower supporting shaft;

(c) extending said connecting cord along a side edge portion of said curtain fabric to repetitively pass through a first coupling hole of said upper supporting shaft to form a handle loop;

(d) extending said connecting cord along said top edge portion of said curtain fabric to pass through a second coupling hole of said upper supporting shaft; and (e) downwardly extending said connecting cord along a corresponding side edge portion of said curtain fabric, and affixing a second connecting end portion of said connecting cord to an opposed supporting end portion of said lower supporting shaft to form said curtain assembly.

13. The method, as recited in claim 12, wherein in said step (a), said upper supporting shaft and said lower supporting shaft are inserted and extend along an upper elongated slot and a lower elongated slot of said curtain fabric respectively so as to detachably affix said upper supporting shaft and said lower supporting shaft to said top edge portion and said bottom edge portion of said curtain fabric respectively.

14. The method, as recited in claim 13, wherein said step (b) comprises a step of passing said first connecting end portion of said connecting cord through said lower supporting shaft so as to detachably affix said first connecting end portion of said connecting cord to said third supporting end portion of said lower supporting shaft.

15. The method, as recited in claim 12, wherein said step (e) comprises the steps of:

extending downwardly said connecting cord along said corresponding side edge portion of said curtain fabric;

passing said second connecting end portion of said connecting cord through said lower supporting shaft; and affixing said second connecting end portion of said connecting cord to said lower supporting shaft.

16. A method of assembling a curtain assembly, comprising the steps of:

(1) detachably affixing an upper supporting shaft and a lower supporting shaft to a top edge portion and a bottom edge portion of a curtain fabric respectively;

(2) detachably affixing a first connecting end portion of a connecting cord to a third supporting end portion of said lower supporting shaft;

(3) extending said connecting cord along a side edge portion of said curtain fabric to repetitively pass through a first coupling hole of said upper supporting shaft to form a handle loop, wherein said first coupling hole is formed in a first extender ring of said upper supporting shaft;

(4) extending said connecting cord along said top edge portion of said curtain fabric to pass through said second coupling hole of said upper supporting shaft, wherein said second coupling hole is formed in a second extender ring of said upper supporting shaft; and (5) downwardly extending said connecting cord along a corresponding side edge portion of said curtain fabric, and affixing a second connecting end portion of said connecting cord to an opposed supporting end portion of said lower supporting shaft to form said curtain assembly.

17. The method, as recited in claim 16, wherein in said step (3) and said step (4), said connecting cord is arranged to pass through connecting holes formed on said side edge portions of said curtain fabric while said connecting cord extends along said side edge portion of said curtain fabric.

* * * * *